US012486100B2

(12) United States Patent
Collier et al.

(10) Patent No.: US 12,486,100 B2
(45) Date of Patent: Dec. 2, 2025

(54) DISPENSER FOR CONSUMABLE PRODUCTS

(71) Applicant: Intercontinental Great Brands LLC, East Hanover, NJ (US)

(72) Inventors: Paul Collier, East Hanover, NJ (US); Sameer Naik, East Hanover, NJ (US); Leonard Scarola, East Hanover, NJ (US); Paul Zerfas, East Hanover, NJ (US)

(73) Assignee: INTERCONTINENTAL GREAT BRANDS LLC, East Hanover, NJ (US)

( * ) Notice: Subject to any disclaimer, the term of this patent is extended or adjusted under 35 U.S.C. 154(b) by 502 days.

(21) Appl. No.: 17/766,340

(22) PCT Filed: Oct. 5, 2020

(86) PCT No.: PCT/US2020/054207

§ 371 (c)(1),
(2) Date: Apr. 4, 2022

(87) PCT Pub. No.: WO2021/086545

PCT Pub. Date: May 6, 2021

(65) Prior Publication Data

US 2024/0051730 A1 Feb. 15, 2024

Related U.S. Application Data

(60) Provisional application No. 62/929,173, filed on Nov. 1, 2019.

(51) Int. Cl.

| | |
|---|---|
| ***B65D 83/04*** | (2006.01) |
| ***B65D 51/24*** | (2006.01) |
| ***B65D 85/60*** | (2006.01) |

(52) U.S. Cl.
CPC ..... *B65D 83/0463* (2013.01); *B65D 51/248* (2013.01); *B65D 85/60* (2013.01); *B65D 2203/02* (2013.01)

(58) Field of Classification Search
CPC .. B65D 51/248; B65D 83/0463; B65D 85/60; B65D 2203/02
See application file for complete search history.

(56) References Cited

U.S. PATENT DOCUMENTS 579,474 A * 3/1897 Barry ..... A61J 7/04 116/308
3,604,559 A 9/1971 McCall
(Continued)

FOREIGN PATENT DOCUMENTS

CA 2 142 365 A1 3/1994
CN 1326414 A 12/2001
(Continued)

OTHER PUBLICATIONS

Pill Smart Opioid Dispenser, Pill/ROBRADY design, https://www.robrady.com/venture/Pill, Apr. 30, 2019, pp. 1-21.
(Continued)

*Primary Examiner* — Gene O Crawford
*Assistant Examiner* — Kelvin L Randall, Jr.
(74) *Attorney, Agent, or Firm* — CANTOR COLBURN LLP

(57) ABSTRACT

A dispenser (10) for easily dispensing a plurality of products (12) contained therewithin is provided. The dispenser includes a cover (14) having a pressing opening (32) and a dispenser volume, a base (16) having an dispensing opening (36) and an engaging member (46), a blister tray (18) having at least a portion of the blister tray disposed within the dispenser volume and having a tab (56) extending from an edge of the blister tray for manually rotating the blister tray
(Continued)

with respect to the cover and base while being retained within the dispenser volume, and a label (20) configured to be applied and adhered to the cover and the engaging member of the base to hold the dispenser together.

30 Claims, 12 Drawing Sheets

(56) References Cited

U.S. PATENT DOCUMENTS

| | | | | |
|---|---|---|---|---|
| 3,800,940 | A | 4/1974 | Thomas | |
| 4,015,717 | A | 4/1977 | Richardson et al. | |
| 4,165,709 | A * | 8/1979 | Studer | B65D 83/0463 206/534 |
| 4,298,125 | A | 11/1981 | Berghahn et al. | |
| 4,488,655 | A | 12/1984 | Itsubo et al. | |
| 4,524,869 | A | 6/1985 | Nader | |
| 4,572,376 | A * | 2/1986 | Wrennall | A61J 7/04 220/253 |
| 4,646,936 | A | 3/1987 | Frazier et al. | |
| 4,667,845 | A | 5/1987 | Frazier et al. | |
| 4,915,256 | A | 4/1990 | Tump | |
| 5,246,136 | A * | 9/1993 | Loidl | A61J 7/0472 221/76 |
| 5,411,295 | A * | 5/1995 | Bates | G09F 3/0292 283/105 |
| D382,474 | S * | 8/1997 | Malmborg | D9/423 |
| 5,725,121 | A * | 3/1998 | Gianpaolo | B65D 5/746 220/784 |
| 5,775,536 | A | 7/1998 | Lambelet, Jr. et al. | |
| 6,062,420 | A | 5/2000 | Krouwel et al. | |
| 6,065,472 | A | 5/2000 | Anderson et al. | |
| 6,112,894 | A | 9/2000 | Kikuchi et al. | |
| 6,364,155 | B1 | 4/2002 | Wolfe | |
| 6,631,825 | B2 | 10/2003 | Garrant et al. | |
| 6,651,840 | B1 | 11/2003 | Van Dullemen et al. | |
| 6,659,281 | B2 | 12/2003 | Gaffney et al. | |
| 6,669,022 | B2 | 12/2003 | Donegan | |
| 6,805,258 | B2 | 10/2004 | Cross | |
| 6,874,652 | B2 | 4/2005 | Christensen et al. | |
| 7,104,417 | B2 | 9/2006 | Hilliard | |
| 9,021,981 | B2 | 5/2015 | Raiti de Boyles | |
| 9,346,609 | B2 | 5/2016 | Schiffmiller et al. | |
| 9,422,101 | B2 | 8/2016 | Wu et al. | |
| 10,105,284 | B2 | 10/2018 | Collins et al. | |
| 10,252,843 | B2 | 4/2019 | Linton et al. | |
| 2003/0111479 | A1 | 6/2003 | Taneja et al. | |
| 2003/0164380 | A1 | 9/2003 | Taneja et al. | |
| 2003/0209558 | A1 * | 11/2003 | Cross | B65D 83/0463 221/25 |
| 2004/0188313 | A1 * | 9/2004 | Tedham | B65D 83/0463 206/531 |
| 2006/0124658 | A1 | 6/2006 | Coe et al. | |
| 2017/0181928 | A1 * | 6/2017 | Collins | B65D 83/0454 |
| 2019/0091107 | A1 | 3/2019 | Brady et al. | |

FOREIGN PATENT DOCUMENTS

| | | | |
|---|---|---|---|
| CN | 1998010 | A | 7/2007 |
| CN | 201406127 | Y | 2/2010 |
| CN | 107411970 | A | 12/2017 |
| DE | 33 48 370 | C2 | 10/2001 |
| GB | 578736 | A | 7/1946 |
| JP | 46-25177 | B | 8/1971 |
| JP | 47-13583 | B | 5/1972 |
| JP | H8-501048 | A | 2/1996 |
| KR | 10-1478126 | B1 | 12/2014 |
| WO | 97/08078 | A1 | 3/1997 |
| WO | 00/29306 | A1 | 5/2000 |
| WO | 00/43287 | A1 | 7/2000 |
| WO | 2004/069688 | A2 | 8/2004 |
| WO | 2011/115762 | A1 | 9/2011 |
| WO | 2016/182951 | A1 | 11/2016 |

OTHER PUBLICATIONS

Box of Ortho-Novin oral contraceptive pills, England, 1960-1968, Ortho Pharmaceutical Limited, pp. 1-3, The Science Museum Group, collection.sciencemuseum.org.uk/objects/co96514/box-of-ortho-novin-oral-contraceptive-bills-england-1960-1968-oral-contraceptive-pill.

Notice of Reasons for Rejection, Japanese Patent Application No. 2022-521421, dated Mar. 8, 2024, 3 pages.

International Preliminary Report on Patentability and Written Opinion of the ISA, International Application No. PCT/US2020/054207, dated May 12, 2022, 15 pages.

International Search Report for International Application No. PCT/US2020/054207; International Filing Date: Oct. 5, 2020; Date of Mailing: Feb. 2, 2021; 7 pages.

Written Opinion for International Application No. PCT/US2020/054207; International Filing Date: Oct. 5, 2020; Date of Mailing: Feb. 2, 2021; 13 pages.

European Application No. 20 796 997.3-1014; Communication pursuant to Article 94(3) EPC dated Mar. 10, 2025; 7 pages.

Japanese Application No. 2023-218963; Office Action with English translation dated Nov. 28, 2024; 8 pages.

* cited by examiner

DISPENSER FOR CONSUMABLE PRODUCTS

CROSS REFERENCE TO RELATED APPLICATIONS

This application is the National Stage of International Application No. PCT/US2020/054207, which designates the U.S., filed Oct. 5, 2020, which claims the benefit of U.S. Provisional Patent Application No. 62/929, 173 filed Nov. 1, 2019, the contents of all of which are incorporated herein by reference in its entirety.

FIELD OF THE INVENTION

The present invention relates to dispensers for consumable products, and more particularly, to a dispenser for consumable products configured for easily dispensing one consumable product at a time from the dispenser.

BACKGROUND OF THE INVENTION

Certain consumable products, such as candies or gums, are normally accommodated in a packaging/dispensing device to protect the products and to provide an ease of use for consumers. Currently, there are various packaging/dispensing devices that are designed and configured to accommodate and dispense the consumable products. Each of these devices normally includes an end seal, which may be ruptured to open and access the products contained therewithin. In addition, most of these devices generally employ a housing such that a consumer can dispense the products therefrom.

While various packaging/dispensing devices for consumable products are available currently in the marketplace, it is desirable to provide a packaging/dispensing device for consumable products such as candies and gums with further improvements.

SUMMARY OF THE INVENTION

According to an embodiment of the present invention, a dispenser for dispensing a plurality of products contained therewithin includes a cover having a pressing opening (or indicated area) and a dispenser volume, a base having an dispensing opening and an engaging member, a blister tray having at least a portion of the blister tray disposed within the dispenser volume and having a tab extending from an edge of the blister tray for manually rotating the blister tray with respect to the cover and base while being retained within the dispenser volume, and a label configured to be applied and adhered to the cover and the engaging member of the base to hold the dispenser together.

These and other aspects of the present invention will be better understood in view of the drawings and following detailed description.

BRIEF DESCRIPTION OF THE DRAWINGS

FIG. 2 is an exploded perspective view of the consumable product dispenser in

FIG. 1;

DETAILED DESCRIPTION OF PREFERRED EMBODIMENTS

Figure 1:
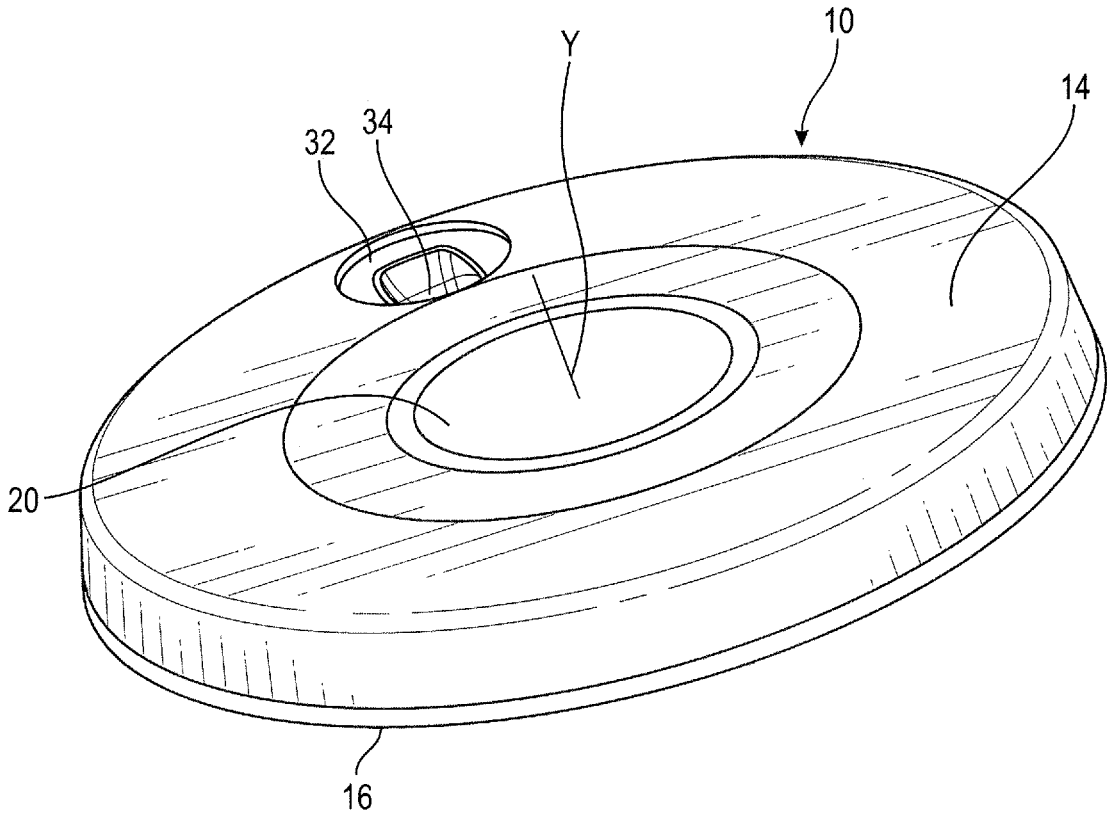
FIG. 1 is a perspective view of a consumable product dispenser, according to an embodiment of the present invention.
Figure 6:
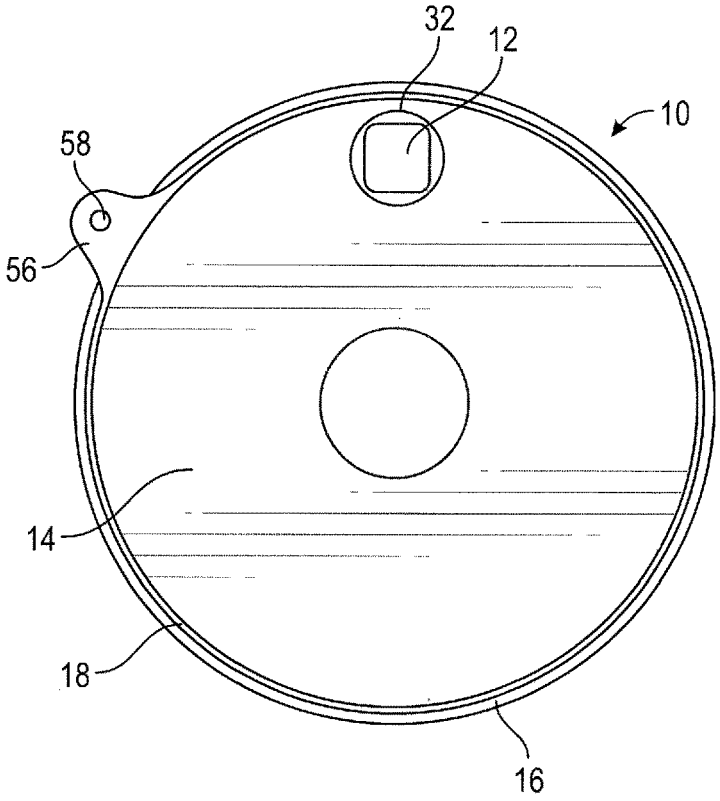
FIG. 6 is a top view of the consumable product dispenser in FIG. 1.
Figure 7:
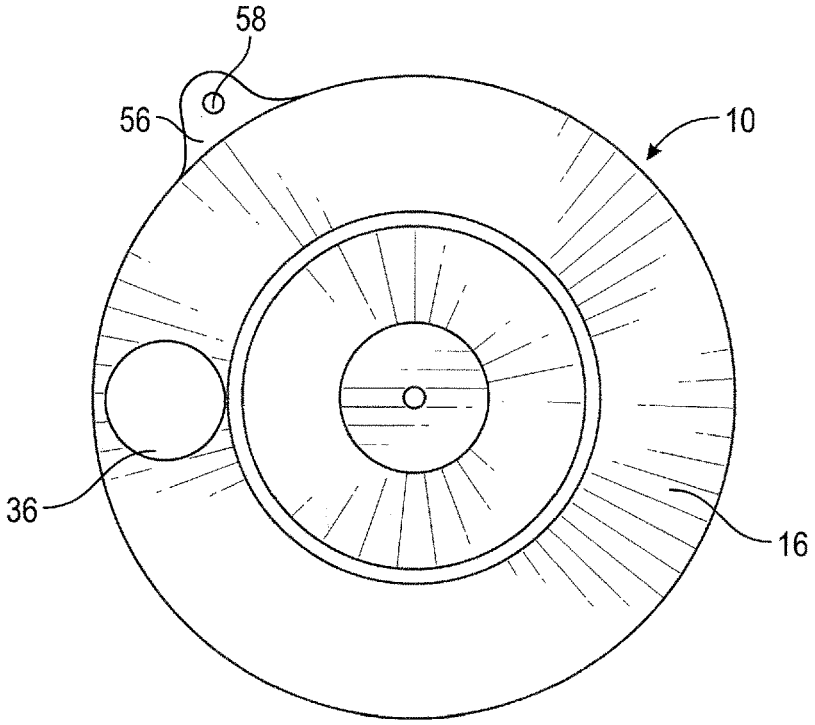
FIG. 7 is a bottom view the consumable product dispenser in FIG. 1.

According to an embodiment of the present invention, referring to FIGS. 1, 6, and 7, there is shown a dispenser 10 for consumable products configured to contain and dispense a plurality of consumable products 12 or confectioneries, such as candies, gums, etc., therewithin. The dispenser 10 is designed and configured to allow the plurality of consumable products 12 to be easily and conveniently dispensed one blister at a time from the dispenser 10, as will be described in greater detail below.

Figure 2:
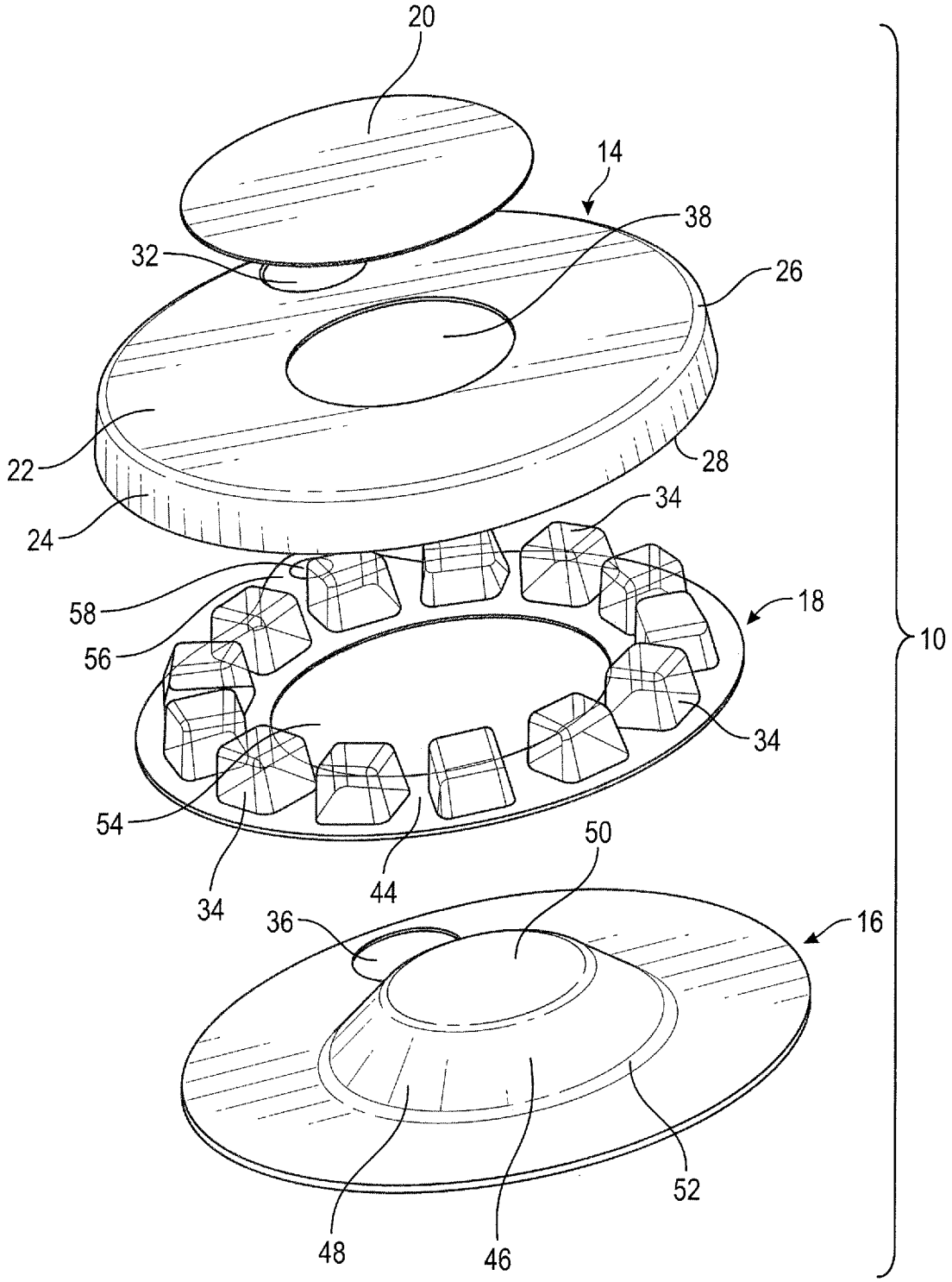

Referring to FIGS. 1 and 2, in a preferred embodiment, the dispenser 10 is generally disc-shaped and includes a cover 14, a base 16 configured to engage with the cover 14, a blister tray 18 configured to be disposed between the cover 14 and the base 16, and a label 20 for holding the dispenser 10 (cover 14, blister tray 18, and base 16) together. When the dispenser 10 is assembled, the blister tray 18 can be manually rotated about a rotation axis Y extending centrally through the dispenser 10 while being retained between the cover 14 and the base 16, as will be described in greater detail below.

Directional terms, such as top and bottom, are referenced to an orientation in which the dispenser 10 is placed on a flat surface with a top of the cover 14 of the dispenser 10 facing upwards. However, the present invention is not thereby limited to use in any particular orientation.

Referring to FIG. 2, in a preferred embodiment, the cover 14 includes a planar top wall 22 and a depending peripheral wall 24, which is connected to the top wall 22 by round transitions 26. The peripheral wall 24 extends between the round transitions 26 and an open end 28 opposite the top wall 22, defining a dispenser volume between the top wall 22 and a bottom end 30 of the peripheral wall 24.

As shown in FIG. 2, a pressing opening 32 is defined near an edge of the top wall 22 to provide a means for manually directly contacting and depressing a blister 34 to dispense the consumable product 12 from the dispenser 10. Once the dispenser 10 is assembled, the pressing opening 32 of the cover 14 is aligned with a dispensing opening 36 defined on the base 16 for the consumable product 12 to be dispensed therethrough, when a user presses the blister 34 located within the pressing opening 32.

The pressing opening 32 and dispensing opening 36 are dimensioned to be larger than the consumable product 12 for dispensing the consumable product 12 disposed within the blister 34. In addition, a cover opening 38 is defined at a center of the top wall 22 for engaging with the base 16 and for the label 20 to be applied thereonto, as will be described in greater detail below.

Figure 3:
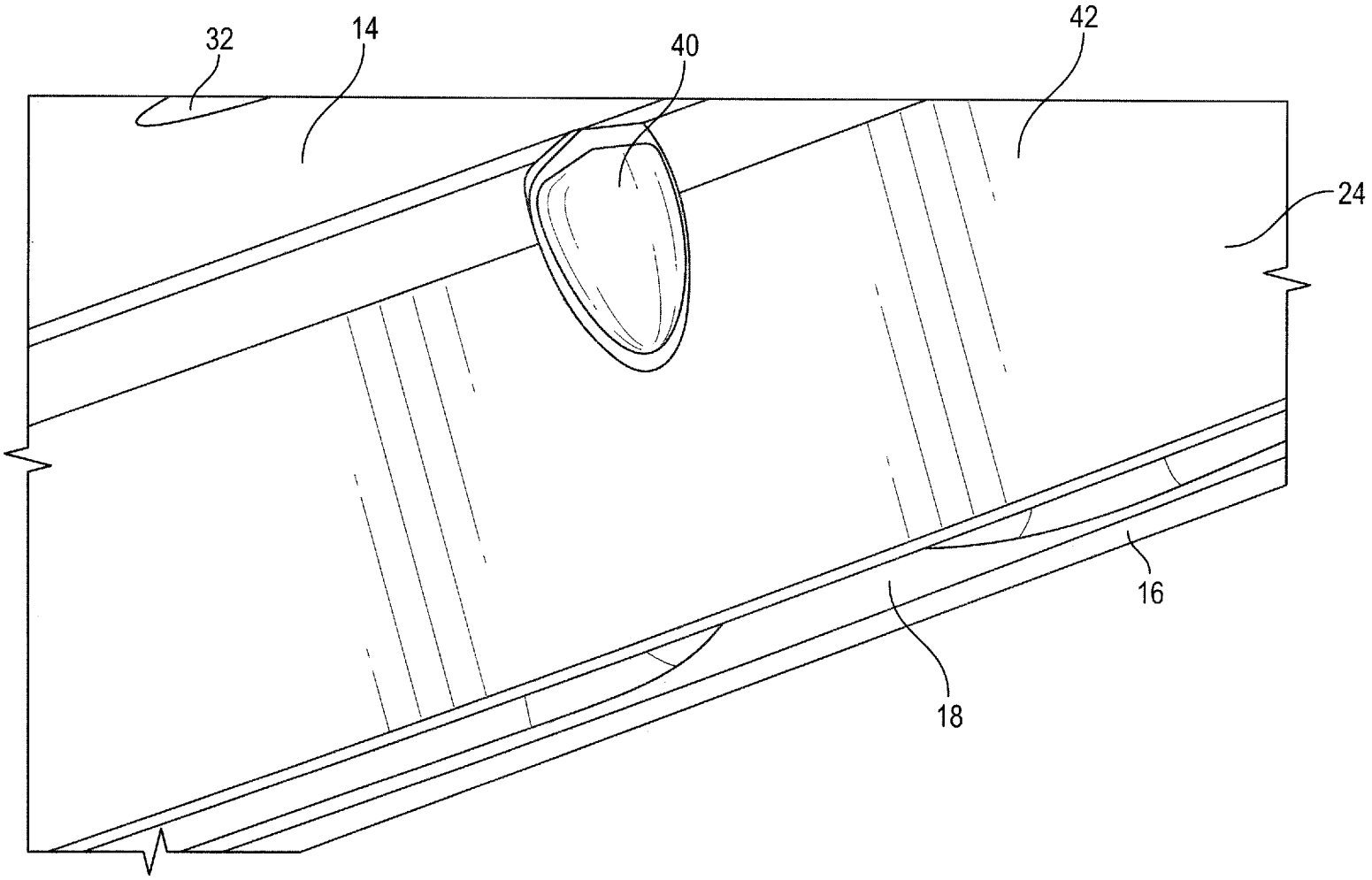
FIG. 3 is a partial inner view of the cover of the consumable product dispenser in FIG. 1.

Referring to FIGS. 2 and 3, the cover 14 further includes an indexing device 40 for providing a detent mechanism when the blister tray 18 is manually rotated. The indexing device 40 is preferably integrally formed on an inner surface 42 of the peripheral wall 24. In a preferred embodiment, the indexing device 40 is located at a top portion of the inner surface 42 of the peripheral wall 24 near the pressing opening 32 of the cover 14, as shown in FIG. 3. The indexing device 40 is a projection that engages with each blister 34 as the blister tray 18 rotates and stops the blister tray 18 once one blister 34 is aligned with the pressing opening 32. As the blister tray 18 rotates, the projection provides a tactile and audible indication of proper alignment of the blister 34 with the pressing opening 32 of the cover 14. Once the blister 34 is aligned with the pressing opening 32 and the blister tray 18 stops rotating, the projection is positioned within a gap 44 between the blister and the next blister. Thus, after the blister 34 is dispensed, the blister tray 18 may be rotated to align the next blister with the pressing opening 32.

Figure 4A:
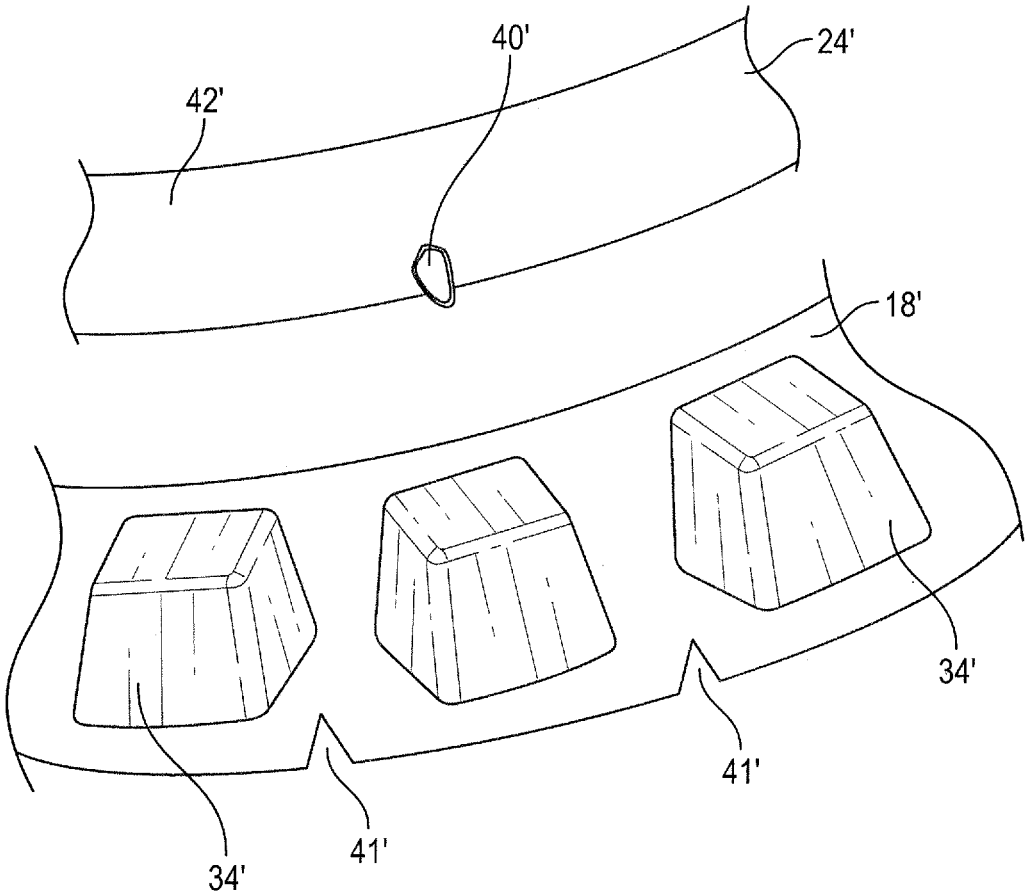
FIG. 4A is a partial inner view of the cover and the blister tray of the consumable product dispenser of an alternate embodiment.

In an alternate embodiment, referring to FIG. 4A, the indexing device 40' is integrally formed at a bottom portion of the inner surface 42' of the peripheral wall 24'. The blistery tray 18' includes a plurality of notches 41', with each of the plurality of notches 41' formed and located in between each of the plurality of the blisters 34'. The indexing device 40' is a projection that is dimensioned to fit into each of the plurality of notches 41' as the blister tray 18' rotates. After the consumable product is dispensed, the blister tray 18' may be rotated such that the indexing device 40' is fitted into the next notch 41' with the next blister being aligned with the pressing opening. As the blister tray 18' rotates, the projection provides a tactile and audible indication of proper alignment of the blister 34' with the pressing opening of the cover 14'.

Figure 4B:
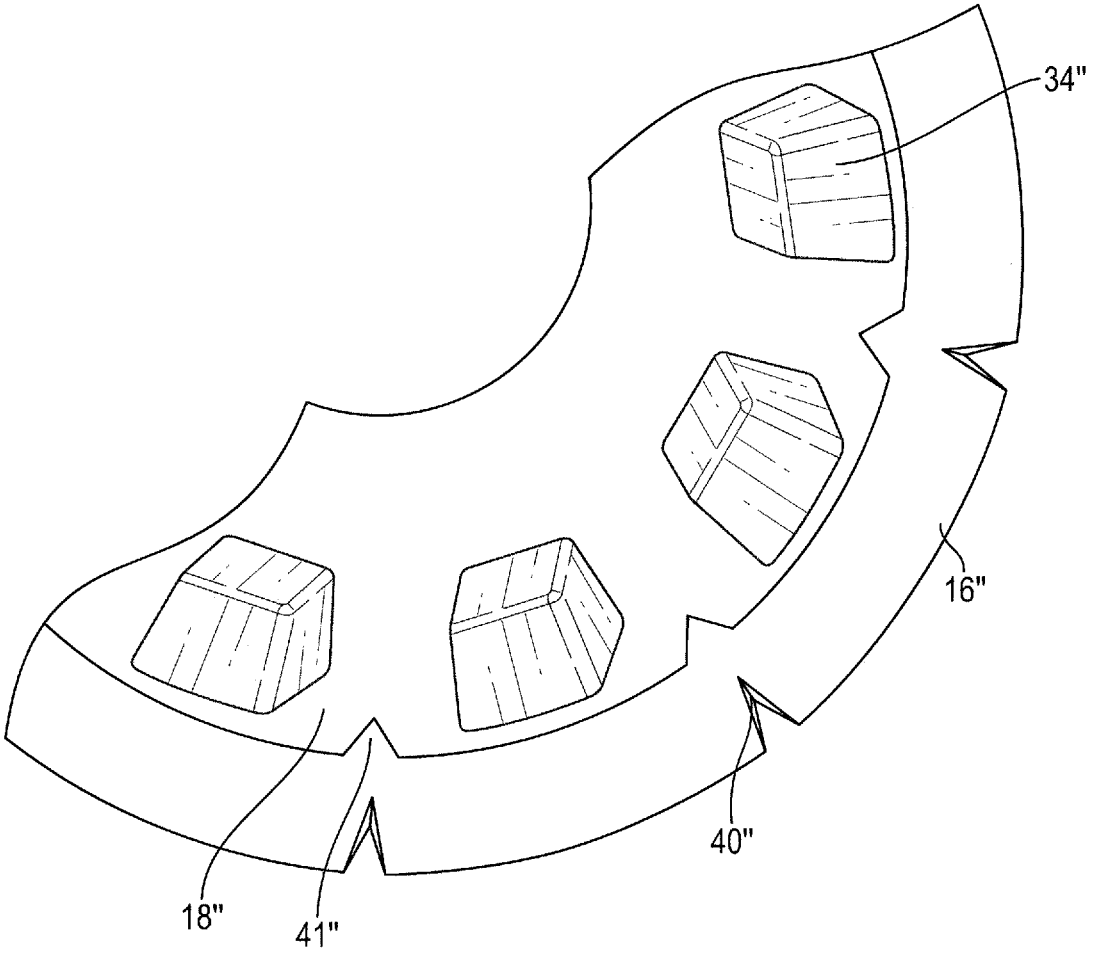
FIG. 4B is a partial view of the blister tray and the base of the consumable product dispenser of an alternate embodiment.

In another alternate embodiment, referring to FIG. 4B, one or more of the indexing devices 40" are integrally formed on the perimeter edge of the base 16". Each of the one or more indexing devices 40" is a projection that is dimensioned to fit into each of the plurality of notches 41" as the blister tray 18" rotates. As the blister tray 18" rotates, the projections provide a tactile and audible indication of proper alignment of the blister 34" with the pressing opening of the cover.

Referring again to FIG. 2, the base 16 includes the dispensing opening 36 that is defined near an edge of the base 16. Preferably, the dispensing opening 36 may be dimensioned similar to the pressing opening 32 of the cover 14. Accordingly, as stated above, once the dispenser 10 is assembled, the pressing and dispensing openings 32, 36 are aligned such that the blister 34 can be pressed from the pressing opening 32 of the cover 14 for dispensing the consumable product through the dispensing opening 36 of the base 16.

The base 16, in a preferred embodiment, further includes an upwardly extending engaging member 46 at a center of the base 16 and protrudes therefrom. The engaging member 46 has a peripheral sidewall 48 extending between a top end 50 and a bottom end 52. The engaging member 46 of the base 16 is designed and dimensioned such that, when the cover 14 engages with the base 16, the top end 50 of the engaging member 46 is positioned within the cover opening 38 of the cover 14. This configuration allows the label 20 to be applied and adhered to both the cover 14 and the base 16 to hold all parts of the dispenser 10 together.

In an alternate embodiment of the base, referring to FIGS. 5A-5D, the top end 50' of the engaging member 46' is square-shaped. However, the top end of the engaging member 46' may have any shape, e.g., circle, triangle, etc. The cover opening has a shape that essentially matches the shape of the top end 50' of the engaging member 46'. In addition, the perimeter edge of the top end 50' has a groove or undercut slot 51' formed therein, and the groove or undercut slot 51' attachingly snaps into the cover opening by means of an interference or snap fit. In other words, the edge of the cover opening snaps into the groove or undercut slot 51' formed in an upper wall portion of the engaging member 46', adjacent to the perimeter edge of the top end 50' of the engaging member 46', forming a non-rotatable attachment. Advantageously, having the shape of the cover opening and the top end 50' being angular or non-circular, sliding rotation of the base with respect to the cover 14' is prevented, rendering the sticky label functionally unnecessary in such an embodiment.

Figure 5A:
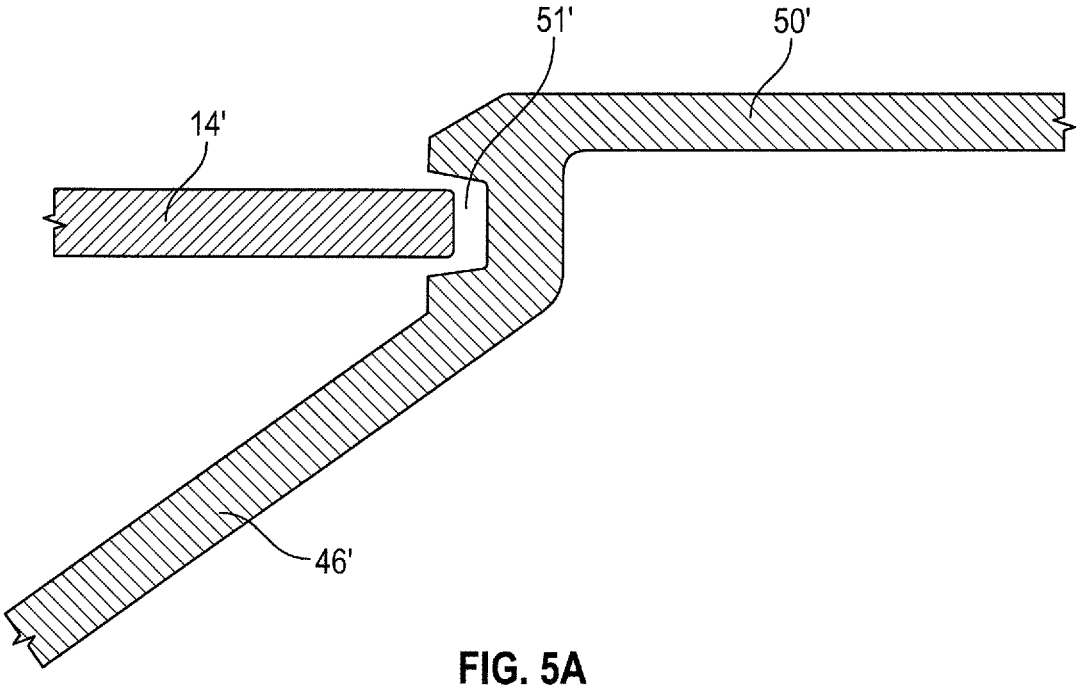
FIG. 5A is a partial cross-sectional view of an attachment of the cover and the base via an interference fit.
Figure 5B:
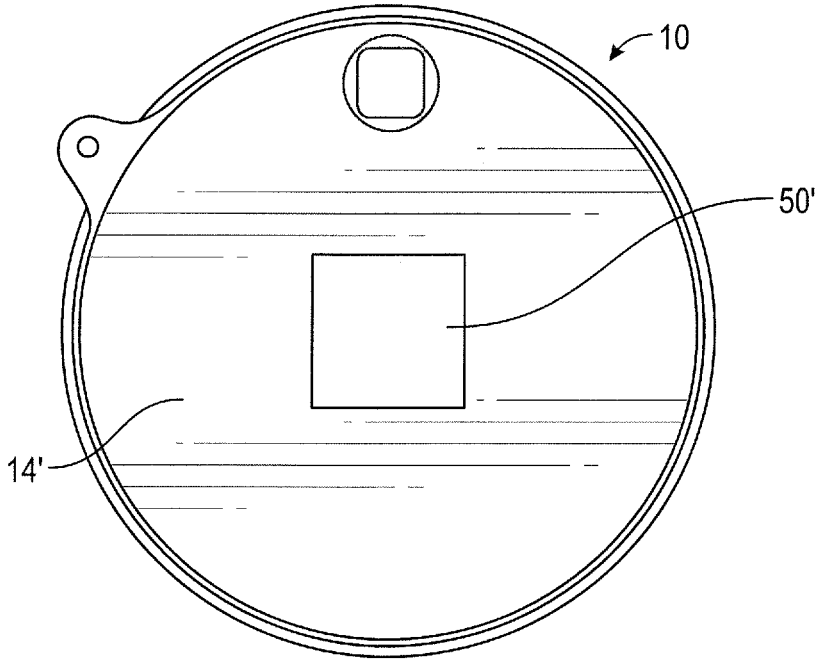
FIG. 5B is a top view of the consumable product dispenser in FIG. 5A.
Figure 5C:
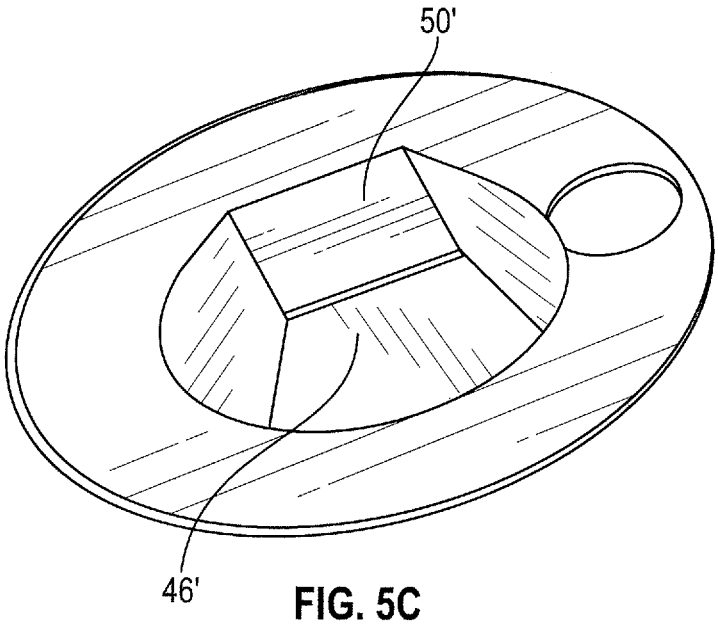
FIG. 5C is a perspective view of the base in FIG. 5B.
Figure 5D:
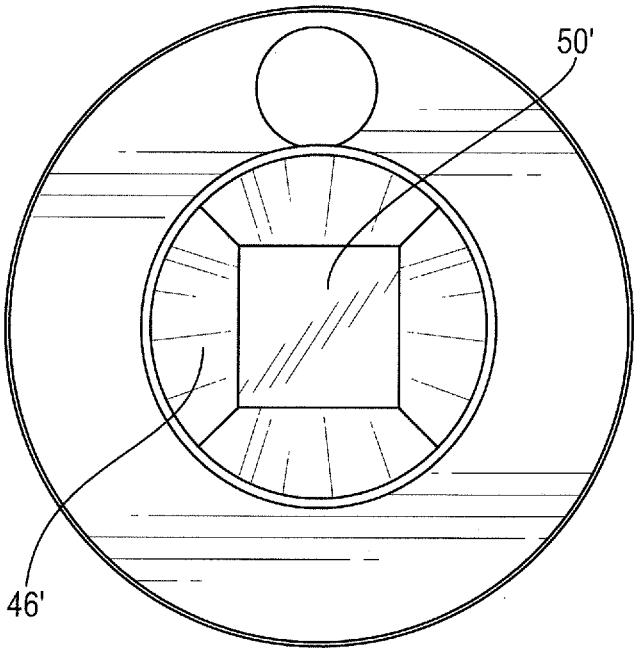
FIG. 5D is a bottom view of the base in FIG. 5C.
Figure 5E:
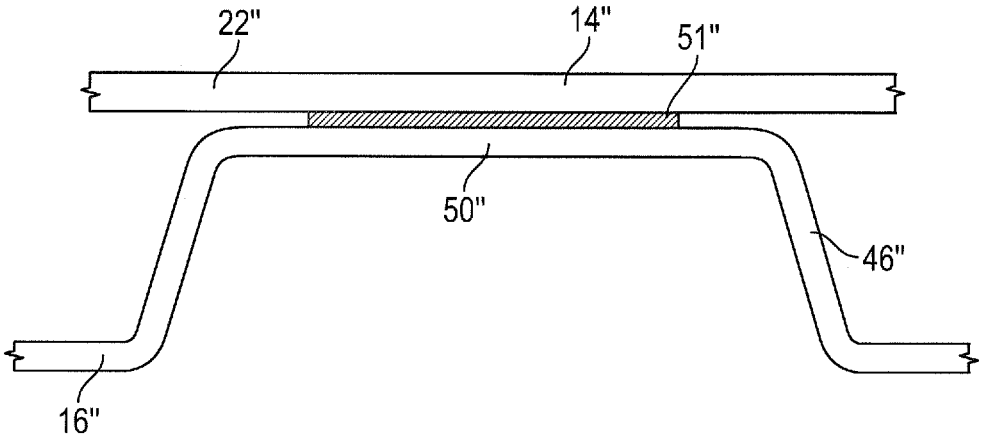
FIG. 5E is a partial cross-sectional view of an attachment of the cover and the base via an adhesive.
Figure 5F:
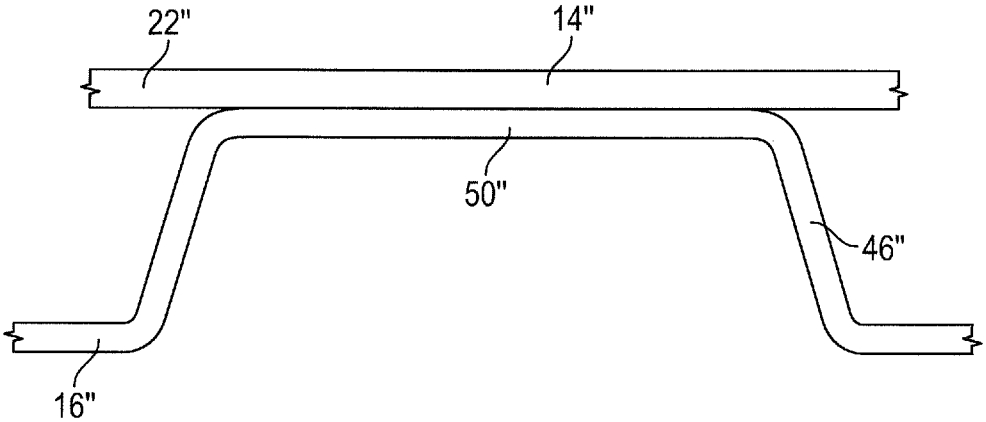
FIG. 5F is a partial cross-sectional view of an attachment of the cover and the base via heat seal or ultrasonic seal.
Figure 5G:
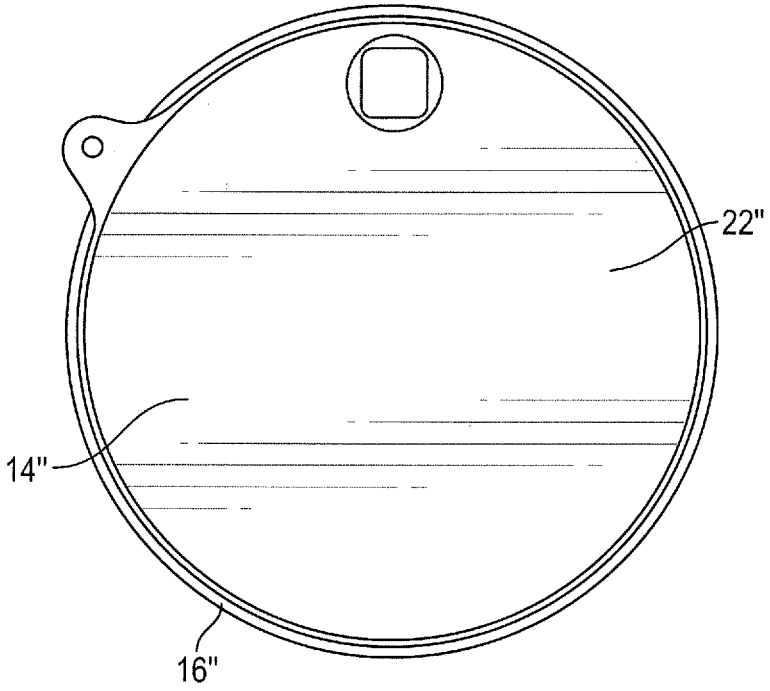
FIG. 5G is a top view of the consumable product dispenser of the alternate embodiment in FIGS. 5E and 5F.

While the attachment of the cover 14 to the base 16 using the label 20 and snap fit technique are disclosed, other attachment techniques are within the contemplations of the present invention. The alternate techniques are illustrated in FIGS. 5E-5G. Referring to FIGS. 5E-5G, the cover 14" is configured without the cover opening on the top wall 22". This configuration of the cover 14" allows the inner surface of the top wall 22" of the cover 14" to be adhered to the top end 50" of the engaging member 46" of the base 16" by an adhesive 51" (FIG. 5E), heat seal (FIG. 5F), or ultrasonic seal (FIG. 5F).

Referring again to FIG. 2, the blister tray 18 is generally annular and disc-shaped. However, the blister tray 18 may be designed in any suitable shape as long as it is rotatable within the dispenser 10. The blister tray 18 includes a plurality of blisters 34 configured to contain consumable products therewithin. The plurality of blisters 34 are desirably arranged about the circumference of the blister tray 18. As known in the industry, a bottom surface of the blister tray 18 is covered with a rupturable sealing material, such as film or foil, which covers an opening of each blister 34. The sealing material may include lines of weakness around the area that covers the opening of each blister 34 for easy rupturing. Each of the plurality of blisters 34 on the blister tray 18 is dimensioned to be closely fitted within each of the pressing and dispensing openings 32, 36. The blisters 34 are sized for the products 12. The pressing and dispensing openings 32, 36 are sized to the blister 34.

The blister tray 18 has a blister tray opening 54 defined at a center thereof. The blister tray opening 54 allows the blister tray 18 to be stably disposed within the dispenser volume of the dispenser 10. Specifically, during the assembly, the engaging member 46 of the base 16 is inserted through the blister tray opening 54 such that the blister tray 18 can be seated on top of the base 16 and disposed within the dispenser volume.

The blister tray 18 further includes a tab 56, which is integrally attached to an edge of the blister tray 18, as shown in FIG. 2. When the dispenser 10 is assembled, the tab 56 extends laterally outwardly from the cover 14 and the base 16 and provides a means for manually rotating the blister tray 18 and for positioning a blister within the aligned openings (pressing opening and dispensing opening) 32, 36. As stated above, once the blister is positioned along the aligned openings 32, 36, a user may press the blister through the pressing opening 32 of the cover 14 until the blister is ruptured and dispensed through the dispensing opening 36 of the base 16. A tab opening 58 may be defined on the tab 56 such that the dispenser 10 may be suspended on a display hook or the like, such as a pegboard hook for retail display. The tab opening 58 also allows the dispenser 10 to be hooked, for example, to a key chain once it is purchased.

Figure 8A:
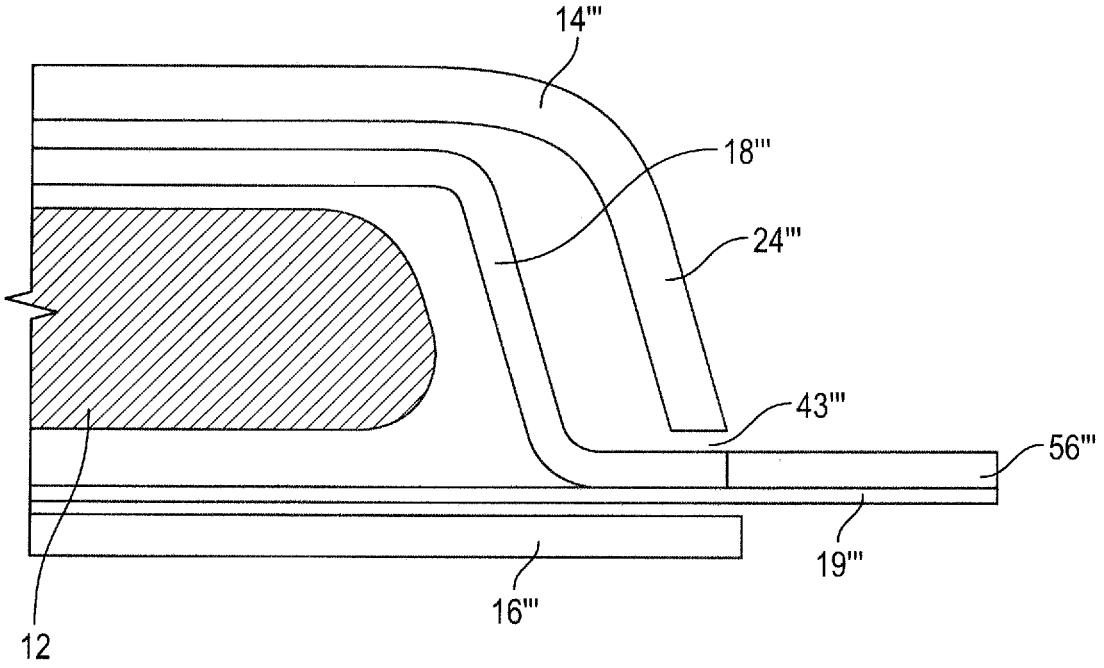
FIG. 8A-8C are partial views of the consumable product dispenser in various embodiments.
Figure 8B:
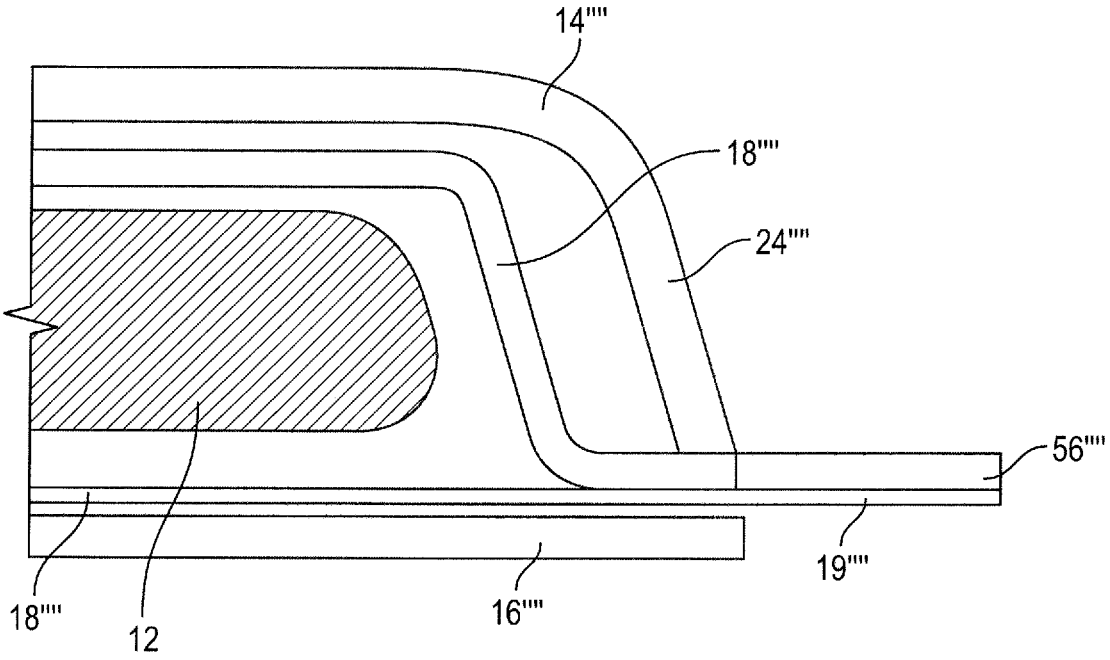
Figure 8C:
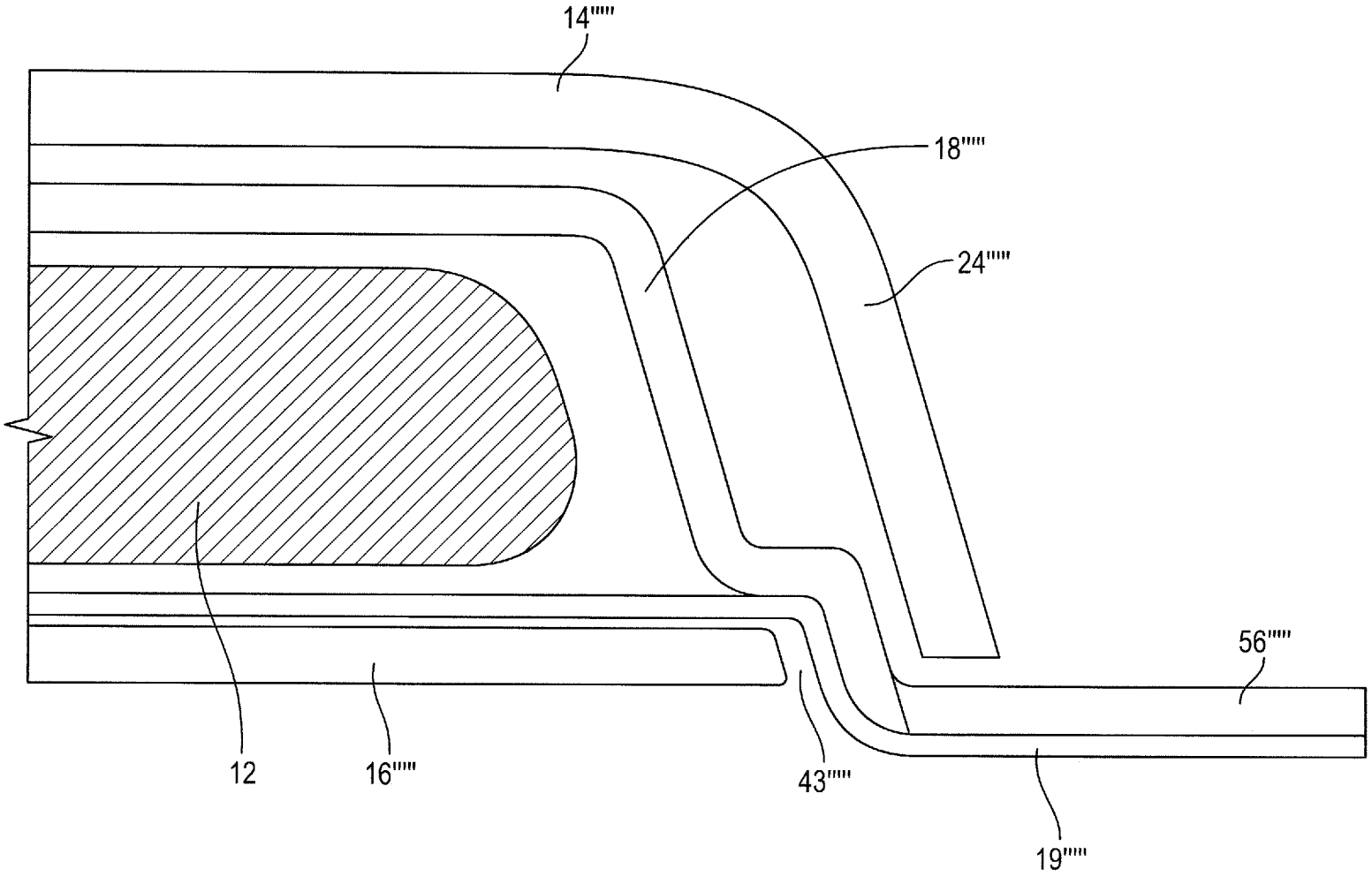

Referring to FIGS. 8A-8C, various designs of the dispenser for consumable products 12 with respect to the configuration of the tab of the blister tray are shown. In FIG. 8A, in one embodiment, the blister tray 18''' having a rupturable sealing material 19''' on the bottom is disposed between the cover 14''' and the base 16'''. A gap 43''' is formed between the bottom of the peripheral wall 24''' of the cover 14''' and the tab 56''' of the blister tray 18''' to allow the blister tray 18''' to be rotated freely without friction between the tab 56''' of the blister tray 18''' and the peripheral wall 24''' of the cover 14'''.

In an alternate embodiment, shown in FIG. 8B, the bottom of the peripheral wall 24'''' of the cover 14'''' engages with the tab 56'''' of the blister tray 18'''' having a rupturable sealing material 19'''', with no gap existing therebetween. Thus, when the blister tray 18'''' is rotated, there exists sliding contact, which is friction between the tab 56'''' of the blister tray 18'''' and the peripheral wall 24'''' of the cover 14''''. The friction may be overcome by manual rotation.

In yet another embodiment, as shown in FIG. 8C, the dispenser is designed such that the peripheral wall 24''''' extends and overlaps the outermost edge of the blister tray 18''''' having a rupturable sealing material 19''''', with an opening 43''''' therebetween. The configuration of the blister tray 18''''' is modified such that the tab 56''''' includes a vertical step like offset. The opening 43''''' allows the tab 56''''' of the blister tray 18''''' to be extended downwardly through the opening 43''''' and then extending laterally therefrom, with the tab 56''''' having the step-like construction. In this embodiment, the tab 56''''' engages neither the base 16''''' nor the cover 14''''', thereby, allowing the blister tray 18''''' to be rotated freely without friction between the tab 56''''' of the blister tray 18''''' and the peripheral wall 24''''' of the cover 14'''''.

Top and side surfaces of the cover 14, a bottom surface of the base 16, and the label 20 may be utilized for various indicia such as pictures, logos, text (including product descriptions), and pricing information to be printed on, embossed in, or otherwise attached, as shown in FIGS. 6 and 7.

The dispenser 10 is made of one or more materials having suitable properties for a desired application, including strength, weight, rigidity, etc. A thermoformed plastic is generally preferred for the cover 14, blister tray 18, and base 16. For the label 20, a pressure sensitive label is generally preferred. In addition, the dispenser 10 is generally preferred to be sized so that it is easily grabbed with one hand and be fitted in a pocket.

From the foregoing, it will be appreciated that a dispenser for consumable products according to the present invention allows consumable products to be to be easily and conveniently dispensed one at a time from the dispenser by manually rotating the blister tray about the dispenser.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and of the claims appended hereto.

What is claimed is:

1. A dispenser for dispensing a plurality of products contained therewithin, the dispenser comprising:

a cover including:

a top wall having a pressing opening; and a peripheral wall extending from the top wall defining a dispenser volume between the top wall and a bottom end of the peripheral wall;

a base having a dispensing opening and an engaging member, the engaging member having a top end and a bottom end; and a blister tray having at least a portion of the blister tray disposed within the dispenser volume, wherein the blister tray has a tab extending from an edge of the blister tray for manually rotating the blister tray with respect to the cover and base while being retained within the dispenser volume, wherein the base and the cover are attached so as to allow the manual rotation of the blister tray therebetween, wherein an opening is defined between the peripheral wall and the base continuously around an entire periphery of the dispenser, and wherein the tab of the blister tray extends laterally through the opening beyond the peripheral wall.

2. The dispenser of claim 1, wherein an inner surface of the top wall of the cover is adhered to the top end of the engaging member of the base by an adhesive, heat seal, ultrasonic seal, or interference fit.

3. The dispenser of claim 1, wherein, when the dispenser is assembled, the pressing opening and the dispensing opening are aligned with a blister disposed along the aligned openings such that the blister can be pressed from the pressing opening for dispensing a product through the dispensing opening.

4. The dispenser of claim 1, wherein the cover of the dispenser further includes an indexing device formed on an inner surface of the peripheral wall.

5. The dispenser of claim 4, wherein the indexing device is a projection that engages with each blister as the blister tray rotates and stops the blister tray once the blister is aligned with the pressing opening of the cover.

6. The dispenser of claim 5, wherein the projection provides a tactile and audible indication of proper alignment of the blister with the pressing opening of the cover, as the blister tray is rotated.

7. The dispenser of claim 4, wherein the indexing device is located at a top portion of the inner surface of the peripheral wall near the pressing opening of the cover.

8. The dispenser of claim 1, wherein a blister tray opening is defined at a center of the blister tray.

9. The dispenser of claim 8, wherein the engaging member of the base is configured to be inserted through the blister tray opening such that the blister tray can be seated on top of the base and disposed within the dispenser volume.

10. The dispenser of claim 1, wherein a cover opening is defined on the top wall of the cover.

11. The dispenser of claim 10, wherein the engaging member of the base is configured such that, when the cover engages with the base, the top end of the engaging member is positioned within the cover opening of the cover.

12. The dispenser of claim 1, wherein the blister tray includes a plurality of blisters configured to contain the products therewithin.

13. The dispenser of claim 12, wherein each of the plurality of blisters is dimensioned to be closely fitted within each of the pressing and dispensing openings.

14. The dispenser of claim 12, wherein the plurality of blisters are arranged about a circumference of the blister tray.

15. The dispenser of claim 1, wherein the dispenser is disc-shaped.

16. The dispenser of claim 1, wherein the blister tray is annular and disc-shaped.

17. The dispenser of claim 1, wherein the peripheral wall of the engaging member extends between the top and bottom ends.

18. The dispenser of claim 1, wherein a tab opening is formed through the tab.

19. The dispenser of claim 1, wherein each of the cover, base, and blister tray is made out of a thermoformed plastic.

20. The dispenser of claim 10, wherein an edge of the cover opening snaps into a slot formed in an upper wall portion of the engaging member, adjacent to a perimeter edge of the top end of the engaging member.

21. The dispenser of claim 20, wherein the engaging member has a non-circular shape at the top end.

22. The dispenser of claim 21, wherein the cover opening has a non-circular shape that matches the non-circular shape of the top end of the engaging member such that the cover and the base form a non-rotatable attachment when the cover opening snaps into the slot.

23. The dispenser of claim 12, wherein the blister tray includes a plurality notches, with each of the plurality of notches formed and located in between each of the plurality of the blisters.

24. The dispenser of claim 23, wherein the indexing device is located at a bottom portion of the inner surface of the peripheral wall near the pressing opening of the cover, the indexing device being a projection that is dimensioned to fit into each of the plurality of notches as the blister tray rotates.

25. The dispenser of claim 1, wherein a gap is formed between a bottom of the peripheral wall of the cover and the tab of the blister tray such that the blister tray is rotated freely without friction between the tab of the blister tray and the peripheral wall of the cover.

26. A dispenser for dispensing a plurality of products contained therewithin, the dispenser comprising:

a cover including:

a top wall having a pressing opening; and a peripheral wall extending from the top wall defining a dispenser volume between the top wall and a bottom end of the peripheral wall;

a base having a dispensing opening and an engaging member, the engaging member having a top end and a bottom end; and a blister tray having at least a portion of the blister tray disposed within the dispenser volume, wherein the blister tray has a tab extending from an edge of the blister tray for manually rotating the blister tray with respect to the cover and base while being retained within the dispenser volume, wherein the base and the cover are attached so as to allow the manual rotation of the blister tray therebetween, wherein a cover opening is defined on the top wall of the cover, wherein the engaging member of the base is configured such that, when the cover engages with the base, the top end of the engaging member is positioned within the cover opening of the cover, and wherein the dispenser further comprises a label configured to be applied to the cover and the engaging member of the base to provide securement of the base to the cover.

27. The dispenser of claim 26, wherein the label is pressure sensitive.

28. A dispenser for dispensing a plurality of products contained therewithin, the dispenser comprising:

a cover including:

a top wall having a pressing opening; and a peripheral wall extending from the top wall defining a dispenser volume between the top wall and a bottom end of the peripheral wall;

a base having a dispensing opening and an engaging member, the engaging member having a top end and a bottom end; and a blister tray having at least a portion of the blister tray disposed within the dispenser volume, wherein the blister tray has a tab extending from an edge of the blister tray for manually rotating the blister tray with respect to the cover and base while being retained within the dispenser volume, wherein the base and the cover are attached so as to allow the manual rotation of the blister tray therebetween, and wherein a bottom of the peripheral wall of the cover engages with the blister tray, with no gap therebetween, such that the bottom of the peripheral wall of the cover is in sliding contact with the blister tray when the blister tray is rotated.

29. A dispenser for dispensing a plurality of products contained therewithin, the dispenser comprising:

a cover including:

a top wall having a pressing opening; and a peripheral wall extending from the top wall defining a dispenser volume between the top wall and a bottom end of the peripheral wall;

a base having a dispensing opening and an engaging member, the engaging member having a top end and a bottom end; and a blister tray having at least a portion of the blister tray disposed within the dispenser volume, wherein the blister tray has a tab extending from an edge of the blister tray for manually rotating the blister tray with respect to the cover and base while being retained within the dispenser volume, wherein the base and the cover are attached so as to allow the manual rotation of the blister tray therebetween, and wherein the peripheral wall extends and overlaps an outermost edge of the blister tray with an opening therebetween to allow the tab of the blister tray to be extended downwardly through the opening and extending laterally therefrom, with the tab having a vertical step-like offset.

30. The dispenser of claim 29, wherein the tab engages neither the base nor the cover, thereby, allowing the blister tray to be rotated freely without friction between the tab of the blister tray and the peripheral wall of the cover.

* * * * *